US005931320A

United States Patent [19]

Gajda et al.

[11] Patent Number: 5,931,320

[45] Date of Patent: Aug. 3, 1999

[54] DRYING RACK

[76] Inventors: James J. Gajda, RD #1 P.O. Box 330; Leonard Richard Gajda, 106 S Scott St., both of New Castle, Pa. 16101; D. Patrick Ledford, RD #3 P.O. Box 320, Slippery Rock, Pa. 16057

[21] Appl. No.: 08/890,148

[22] Filed: Jul. 9, 1997

[51] Int. Cl.[6] ..... A47F 5/00

[52] U.S. Cl. ..... 211/193; 211/205; 211/189; 211/1.3

[58] Field of Search ..... 211/193, 186, 211/205, 196, 189, 1.3

[56] References Cited

U.S. PATENT DOCUMENTS

| | | | |
|---|---|---|---|
| 2,542,137 | 2/1951 | Hanson | 211/196 X |
| 2,621,802 | 12/1952 | Stover | 211/1.3 X |
| 3,023,912 | 3/1962 | Sebastian | 211/196 |
| 3,051,320 | 8/1962 | De Loss Barnett | 211/196 |
| 3,464,644 | 9/1969 | Nugent | 211/196 X |
| 3,730,354 | 5/1973 | Bronstein . | |
| 4,297,795 | 11/1981 | Licari . | |
| 4,541,344 | 9/1985 | Nichols | 211/193 X |
| 4,592,473 | 6/1986 | Efrom | 211/205 |
| 5,044,507 | 9/1991 | Shulyak . | |
| 5,213,221 | 5/1993 | Raye, Sr. . | |
| 5,219,080 | 6/1993 | Reyes . | |
| 5,224,104 | 6/1993 | Green et al. . | |
| 5,509,544 | 4/1996 | Osborn . | |

FOREIGN PATENT DOCUMENTS

| | | | |
|---|---|---|---|
| 191573 | 1/1923 | United Kingdom | 211/205 |

*Primary Examiner*—Robert W. Gibson, Jr.
*Attorney, Agent, or Firm*—Andrew J. Cornelius

[57] ABSTRACT

A rack for drying or curing items can be disassembled for storage or transportation. The rack includes a pair of rack units, each rack unit including a base, an upright and a series of elongated members, or poles, on which the items can be supported above the generally flat surface on which the unit rests. The base includes three legs that engage the flat surface. The series of poles is supported by the upright. The upright is hollow and can be used to store the poles and base legs. A cap is provided to close the upright to keep out moisture and dirt when the rack is in use, and to ensure that the poles and base legs remain in the upright, and are protected, during transportation or storage of the unit.

6 Claims, 4 Drawing Sheets

DRYING RACK

BACKGROUND OF THE INVENTION

The present invention relates to racks, and, more particularly, to a rack that is used dry items and materials that have been treated.

Those operating in the building construction, improvement and restoration industries often treat items and materials at the worksite that must cure or dry before the items and materials can be installed or used. For example, new windows, shutters, baseboard, casing, doors and other solid objectsare typically painted or stained and installed only after they dry. During restoration work, doors, shutters, or other solid objects or components are removed from the building, and repaired and restored on site. The restoration work typically involves repainting or restaining these components, and they must dry before they can be reinstalled. Components that must dry or cure should be stabilized in a position that promotes drying or curing of the components at a location that does not interfere with other tasks at the worksite, and that protects the components and other surfaces and the surrounding areas from damage.

U.S. Pat. No. 5,509,544 ("Osborn") discloses rack that consists of a pair of assemblies that are spaced from each other during use. Each assembly includes a series of poles that are mounted at their ends to a pair of uprights by hooks that are mounted to the uprights along their length. The ends of the poles are supported by these hooks, and are, therefore, spaced vertically along the uprights. Each horizontally mounted pole serves to support one end of a component like a door or shutter. Accordingly, the component is supported by a pole of each assembly between the two assemblies.

The rack shown in Osborn has several drawbacks. The hooks that are provided to mount the poles can get in the way, and harm personnel, clothing or construction materials, during both use and transportation of the rack. The need to use a pair of uprights for each rack assembly complicates the construction and use of the rack. The method of transporting the rack when it is disassembled permits the poles from becoming disassociated from the base during transportation, and permits damage to occur to the poles.

There is, therefore, a need for a rack to hold a large quantity of construction components or objects in a small space while they are curing and drying that is easy to assemble and transport.

SUMMARY OF THE INVENTION

The present invention provides a rack for supporting items above a surface that includes an item support with support members on which the items rest and a base to which the item support can be removably mounted to space the support members from the surface. The rack can include a storage compartment for the support members and the legs of the base. Preferably, the support members are elongated, and the item support includes an upright to which the support members are mounted. The item support can be a hollow conduit that serves as the storage compartment and include a removable end cap for closing the compartment.

The present invention also provides a rack for supporting items above a surface that includes an upright secured to a base, and item support members extending from the upright on which the items are supported above the surface, the upright defining a storage compartment for the item support members and the legs of the base. The item support members can be removably mounted to the upright by passing each member through openings defined by the upright until an equal length of the member extends from either side of the upright.

The present invention also provides a rack for drying or curing items that includes a pair of rack units, each unit including a base adapted to rest on a generally horizontal flat surface, the base including three base legs that can be removably mounted to the base, the legs being oriented to engage the surface, an upright removably mounted to and extending upwardly from the base, the upright defining a series of openings through the upright, a series of elongated item support members that can be removably mounted to the upright by passing each of the support members through an opening in the upright until a substantially equal length of the support extends on either side of the upright. The upright can define a storage compartment in which the base legs and the item supports can be stored during transportation of the rack, the upright including a removable closure for the storage compartment. The upright can be a hollow conduit, the item support members can be poles, the closure can be a cap for the upper end of the conduit, and the base can include a base cap for the lower end of the conduit, the base legs being threaded into the base cap.

The present invention also provides a rack for drying or curing items including a pair of rack units, each unit including a single hollow elongated upright removably mounted to and extending upwardly from a base, the upright defining a series of openings through the upright the base being adapted to rest on a generally horizontal flat surface, and including a base cap that fits over the lower end of the upright and three base legs that can be threaded into the base, the legs being oriented to engage the surface, a series of item support poles that can be removably mounted to the upright by passing each pole through an opening in the upright until a substantially equal length of the pole extends on either side of the upright. The upright defines an enclosed hollow compartment in which the base legs and the support poles can be stored during transportation of the rack, the compartment including a removable closure. The base legs can engage the support surface at substantially an 3 degree angle.

Accordingly, the present invention provides a rack for holding a large quantity of components in a small or limited space that is easy to assemble and disassemble at the worksite, and that can be transported easily.

BRIEF DESCRIPTION OF THE DRAWING

The following detailed description of the preferred embodiment may be understood better if reference is made to the appended drawing, in which.

DETAILED DESCRIPTION OF THE PREFERRED EMBODIMENT

Figure 1:
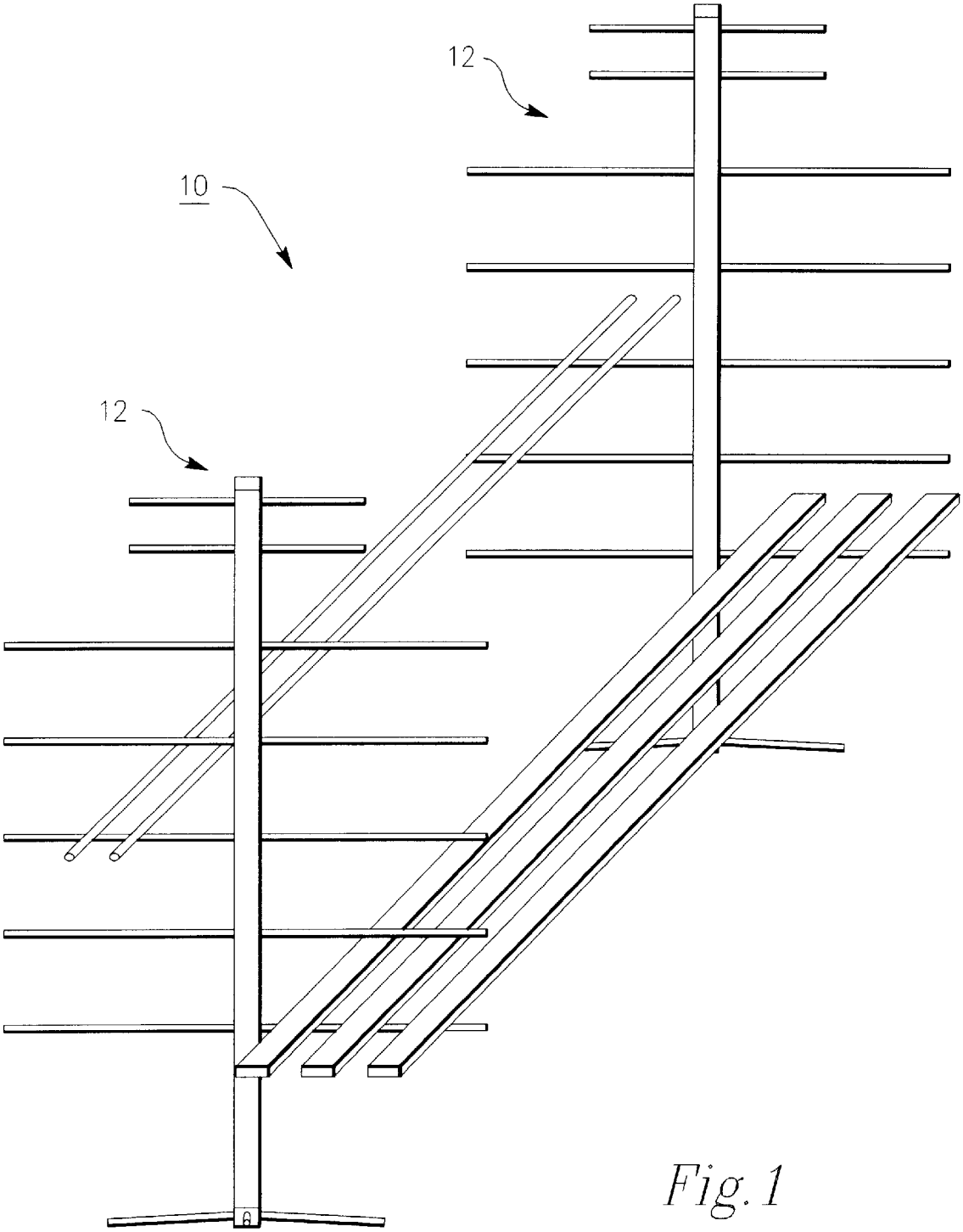
FIG. 1 is a perspective view of a rack provided by the present invention.

FIG. 1 shows drying rack 10, which constitutes the preferred embodiment of the present invention, that is set up to support and dry or cure a variety of products, including baseboard, door and window casing, cabinets, window grilles, paneling and drywall, and smaller pieces of wooden furniture. Rack 10 consists of at least a pair of rack units 12, each of which rests on a generally flat, horizontal surface. Each unit 12 includes a base 14, an upright 16 that is supported by the base, and five longer poles 18 and two shorter poles 20 that are supported by upright 16, all of which can be constructed of thin walled steel conduit. Poles 18 and 20 are used to support the products on rack 10. Base 14 is adapted to support and stabilize on a surface both unit 12 and the items that are supported by poles 18 and 20. Usually, two units 12 will be sufficient to hold in a sufficient quantity the items that are typically found at the worksite. Where, however, particularly long or bulky items or materials need to dry or cure, or where a large number of products must be held at one time, three or more units 12 can be used. Also, the shape and size of the components of units 12 can be tailored to optimize rack 10 for the number and size of products that are to be held by rack 10. For example, the components of unit 12 can be smaller, and the number of product supports 18 and 20 can be fewer, if the number and size of the products that the user expects to store on rack 10 at any time are relatively small. Also, supports 18 and 20 can include guides, pins or support rods if rack 10 is used to hold "round" objects, like pillars, spindles and posts, to prevent the objects from rolling off the supports.

Base 14 includes a bottom cap 22, a front leg 24 and two rear legs 26. Cap 22 is formed in the shape of a cylinder that defines an open end 28 that is sized to receive the lower end 30 of upright 16. Lower end 30 of upright 16 and open end 28 of cap 22 can be sized to provide a friction fit between cap 22 and upright 16. Alternately, cap 22 can be mounted to lower end 28 using other suitable means such as welding or fasteners. Cap 22 defines three drilled and tapped openings that are adapted to receive threaded ends 34 and 38 of legs 24 and 26, respectively. If necessary, lower end 30 of upright 16 can include corresponding openings that permit ends 34 and 38 to be threaded into cap 22. A front opening 32, which is shown best in FIG. 5, receives end 34 of leg 24. A pair of rear openings 36, only one of which is shown—in FIG. 6—receives ends 38 of legs 26. The orientation of each of threaded openings 32 and 36 causes legs 24 and 26 to form a 3 degree angle with the surface on which base 14 rests during use. Ends 40 of legs 24 and 26 engage the surface to stabilize unit 12 and the products and items that are supported by unit 12. Preferably, each of legs 24 and 26 is 12 inches long.

Figure 2:
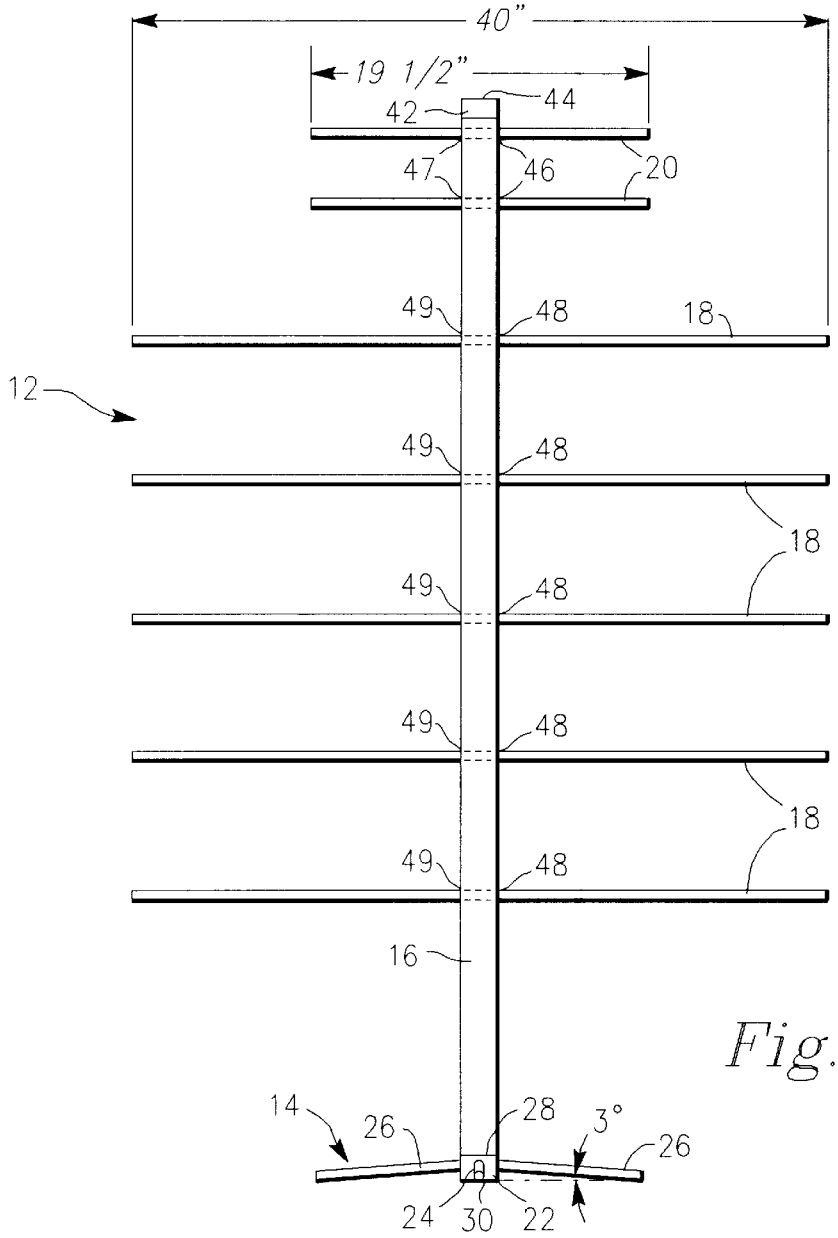
FIG. 2 is a front elevation view of a rack unit shown in FIG. 1.

Upright 16 has a circular cross-section, and is 62½" high and 2⅛" in diameter. Upright 16 supports poles 18 and 20 in positions in which they can support the items supported by rack 10. A metal cap 42 is sized to slip over upper end 44 of upright 16. A pair of openings 46 is formed in upright 16 near the top of upright 16. A pair of corresponding openings 47 of the same size as openings 46 is formed in upright 16 on the side of upright 16 that is directly opposite openings 46. Openings 46 and 47 are large enough to permit poles 20 to be inserted through them but small enough to ensure that poles 20 will remain in place when items are placed on them to be dried or cured. Preferably, openings 46 and 47 have a diameter of 9/16 inches. Accordingly, a pole 20 can be mounted to upright 16 by inserting it through upright 16 through an opening 46 and a corresponding opening 47 on the other side of upright 16, until approximately equal lengths of pole 20 extend from either side of upright 16, as is shown in FIG. 2. Preferably, the uppermost pair openings 46 and 47 are located at a distance of 2 inches from the top of cap 42, with the remaining pair of openings 46 and 47 being spaced a distance of 6 inches from the top of cap 42, or 4 inches from the uppermost pair. Openings 46 and 47 are aligned to ensure that poles 20 are generally parallel to each other when they are mounted to upright 16.

Similarly, five openings 48 are formed in upright 16 below openings 46, and five openings 49 are formed in upright 16 below openings 47 directly opposite openings 48. Openings 48 and 49 are large enough to permit poles 18 to be inserted through them but small enough to ensure that poles 18 will remain in place when items are placed on them to be dried or cured. Preferably, openings 48 and 49 have a diameter of 9/16 inches. Accordingly, a pole 18 can be mounted to upright 16 by inserting it through upright 16 through an opening 48 and a corresponding opening 49 on the other side of upright 16, until approximately equal lengths of pole 18 extend from either side of upright 16, as is shown in FIG. 2. Preferably, the uppermost pair of openings 48 and 49 are located at a distance of 8 inches from the lower pair of openings 46 and 47, with the remaining four pairs of openings 48 and 49 being spaced at 8 inch intervals below the uppermost pair of openings 48 and 49. Openings 48 and 49 are aligned to ensure that poles 18 are all generally parallel to each other and to poles 20 when they are mounted to upright 16.

Figure 4:
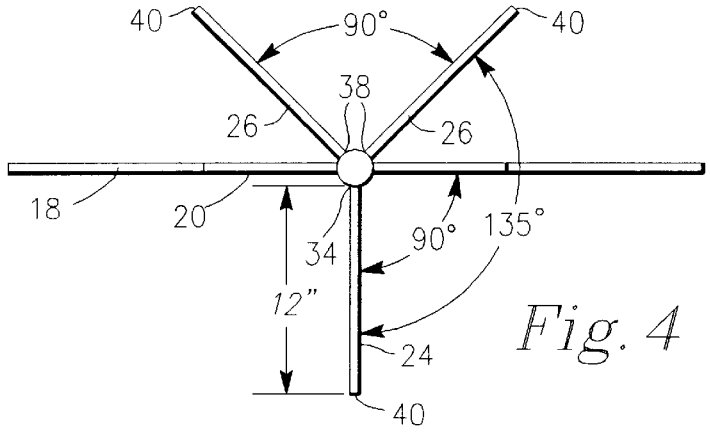
FIG. 4 is a top plan view of the rack unit shown in FIG. 2.
Figure 3:
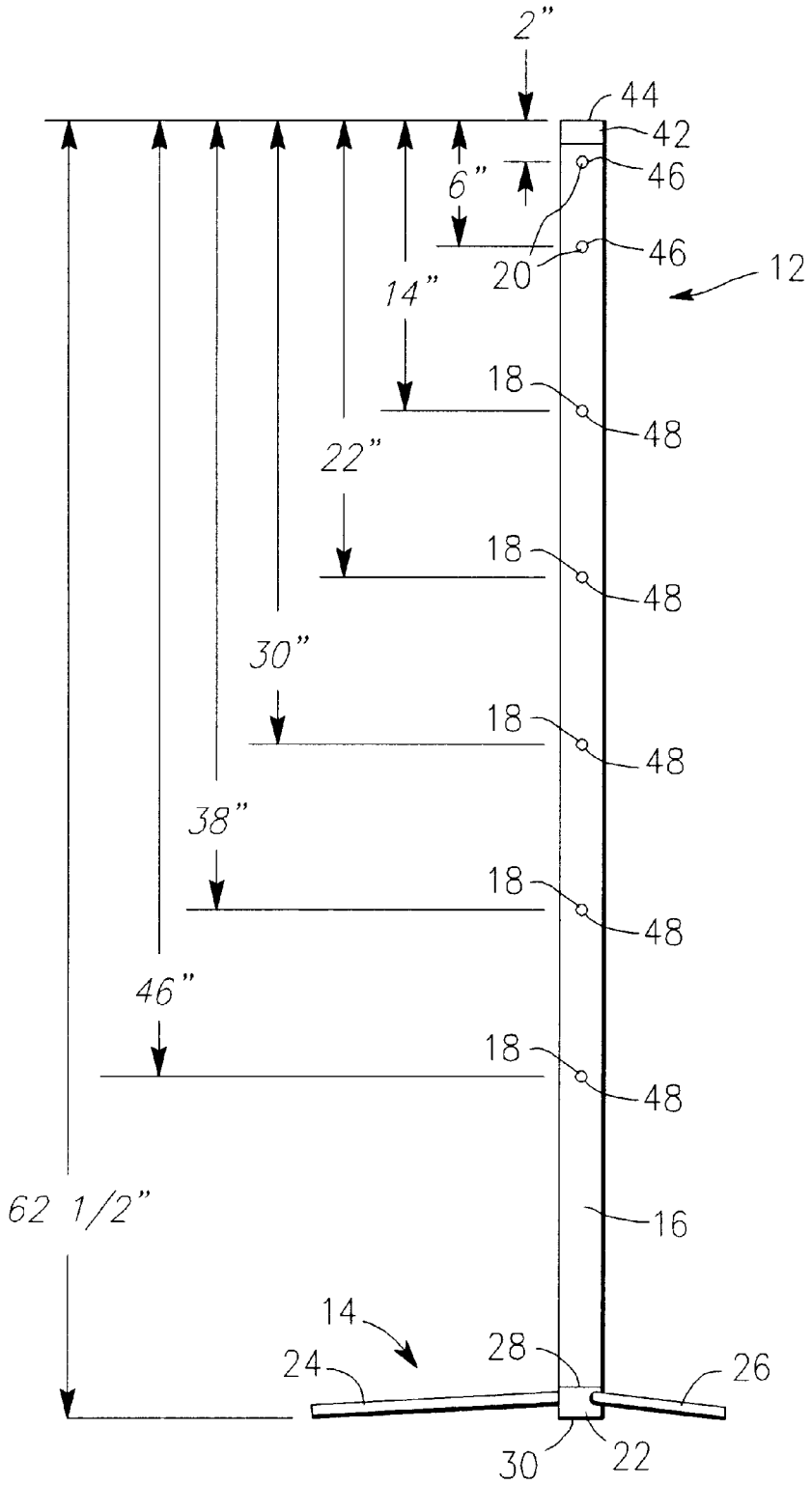
FIG. 3 is a side elevation view of the rack unit shown in FIG. 2.

Opening 32 in bottom cap 22 is positioned to ensure that front leg 24 is oriented at a ninety degree angle to poles 18 and 20 to provide stability for unit 12 when it is in use. Each of openings 36 is oriented to ensure that each of legs 26 forms a 135 degree angle with front leg 24, and a ninety degree angle with each other. Accordingly, each of legs 24 forms a 45 degree angle with poles 18 and 20, as can be seen from FIG. 4.

Assembly of rack 10 begins with the assembly of bases 14 of each unit 12. For each unit 12, each leg 26 is threaded into an opening 36 and leg 24 is threaded into opening 32 in bottom cap 22 and, if necessary, lower end 30 of upright 16. Ends 40 of legs 24 and 26 are placed on the surface, and lower end 30 of upright 16 is inserted into open end 28 of cap 22 to mount upright 16 to base 14. Poles 20 are mounted to upright 16 by inserting them through corresponding openings 46 and 47 until substantially equal lengths of poles 20 extend from either side of pole 16. Then, poles 18 are inserted through corresponding openings 48 and 49 of upright 16 until substantially equal lengths of poles 18 extend from either side of upright 16. Finally, the items that need to be dried or cured are placed on poles 18 or 20. The items can be placed on either side of upright 16. That is, the load on rack 10 need not be balanced.

Figure 5:
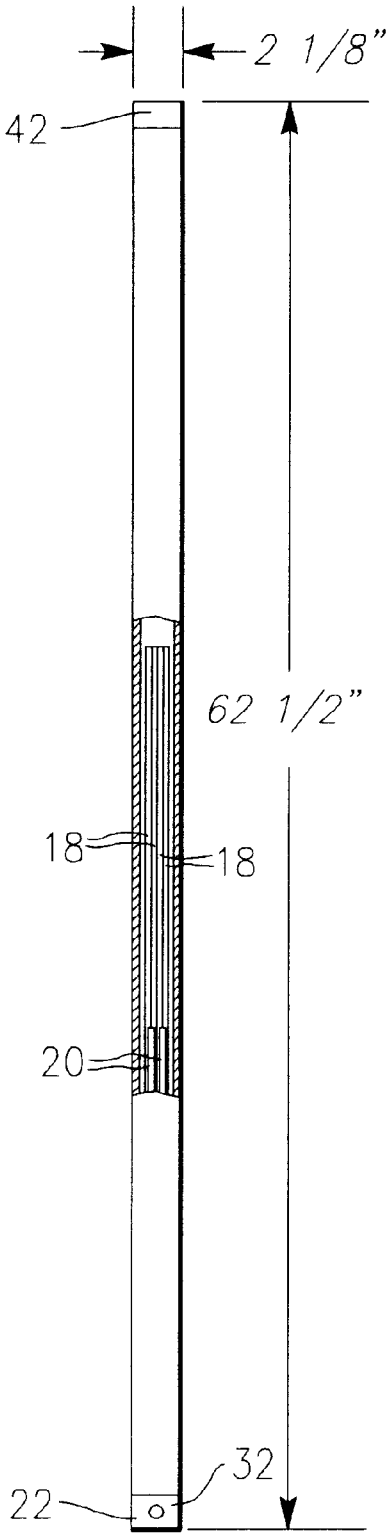
FIG. 5 is a front elevation view of the rack unit shown in FIG. 2 prepared for transportation or storage.
Figure 6:
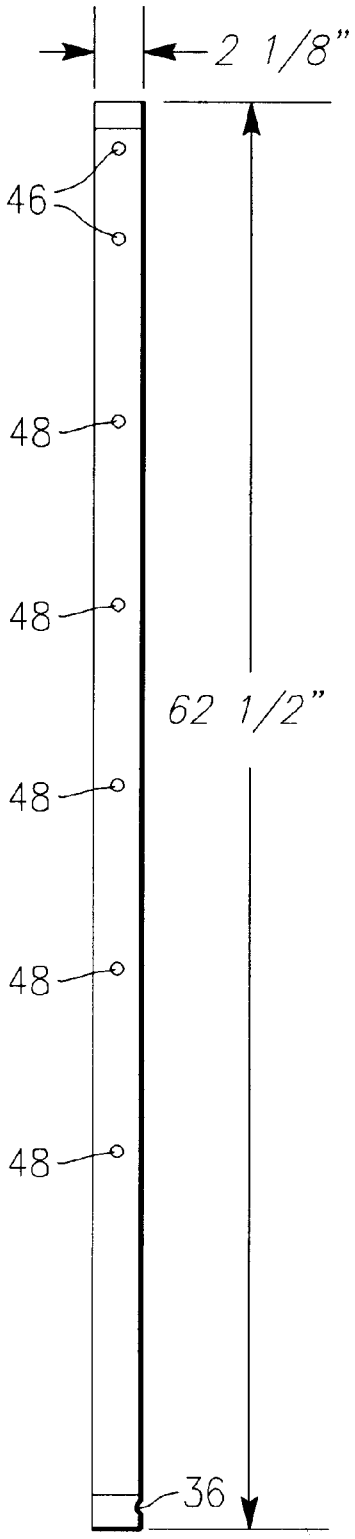
FIG. 6 is a side elevation view of the rack unit shown in FIG. 5.

Rack 10 is disassembled by removing poles 18 and 20 from each upright 16, and unthreading legs 24 and 26 from each of caps 22. Each unit 12 can be prepared for transportation by removing cap 42 from the top of upright 16, placing poles 18 and 20, and legs 24 and 26 into upright 16, and replacing cap 42 onto end 44 of upright 16, as shown in FIGS. 5 and 6. One of the primary advantages of rack 10 is that units 12 are easily transportable. Upright 16 provides a case that is streamlined and easy to carry. When placed in a truck or other vehicle for transportation to another worksite, there are no projections that can damage personnel, clothing or other equipment or materials, or that would make efficient storage impractical. If desired, a handle may be provided on the outer surface of upright 16 to facilitate carrying unit 12.

What is claimed is:

1. A rack for supporting items above a surface comprising an upright secured to a base, and item support members extending from said upright on which the items are supported above the surface, said upright defining a storage compartment for said item support members wherein said item support members are removably mounted to said upright by passing each said member through openings defined by said upright until an equal length of said member extends from either side of said upright.

2. A rack for drying or curing items comprising:

a pair of rack units, each said unit comprising:

a base adapted to rest on a generally horizontal flat surface, said base including three base legs that can be removably mounted to said base, said legs being oriented to engage said surface;

an upright removably mounted to and extending upwardly from said base, said upright defining a series of openings through said upright;

a series of elongated item support members that can be removably mounted to said upright by passing each said support members through a said opening in said upright until a substantially equal length of said support extends on either side of said upright;

said upright defining a storage compartment in which said base legs and said item supports can be stored during transportation of said rack, said upright including a removable closure for said storage compartment.

3. The rack recited by claim 2 wherein said upright is a hollow conduit, said item support members are poles, said closure is a cap for the upper end of said conduit, and said base includes a base cap for the lower end of said conduit, said base legs being threaded into said base cap.

4. A rack for drying or curing items comprising:

a pair of rack units, each said unit comprising:

a single hollow elongated upright removably mounted to and extending upwardly from a base, said upright defining a series of openings through said upright;

said base being adapted to rest on a generally horizontal flat surface, and including a base cap that fits over the lower end of said upright and three base legs that can be threaded into said base, said legs being oriented to engage said surface;

a series of item support poles that can be removably mounted to said upright by passing each said pole through a said opening in said upright until a substantially equal length of said pole extends on either side of said upright;

said upright defining an enclosed hollow compartment in which said base legs and said support poles can be stored during transportation of said rack, said compartment including a removable closure.

5. The rack recited by claim 4 wherein said base legs engage said support surface at substantially an 3 degree angle.

6. A method of drying or curing items, comprising the steps of providing a rack that includes a pair of rack units, each said unit comprising:

a base adapted to rest on a generally horizontal flat surface, said base including three base legs that can be removably mounted to said base, said legs being oriented to engage said surface;

an upright removably mounted to and extending upwardly from said base, said upright defining a series of openings through said upright;

a series of elongated item support members that can be removably mounted to said upright by passing each said support members through a said opening in said upright until a substantially equal length of said support extends on either side of said upright;

said upright defining a storage compartment in which said base legs and said item supports can be stored during transportation of said rack, said upright including a removable closure for said storage compartment; and placing items on said item supports for drying or curing.

* * * * *